United States Patent [19]

Klein

[11] Patent Number: 4,498,450

[45] Date of Patent: Feb. 12, 1985

[54] GANG SAW FOR CUTTING BLOCKS OF STONE

[75] Inventor: Artur Klein, Netphen, Fed. Rep. of Germany

[73] Assignee: General Electric Company, Worthington, Ohio

[21] Appl. No.: 515,448

[22] Filed: Jul. 20, 1983

Related U.S. Application Data

[63] Continuation of Ser. No. 268,448, May 29, 1981, abandoned.

[30] Foreign Application Priority Data

Feb. 3, 1981 [DE] Fed. Rep. of Germany ..... 3103482

[51] Int. Cl.[3] ..... B28D 1/02

[52] U.S. Cl. ..... 125/16 R; 125/19

[58] Field of Search ..... 125/19, 16, 16 R, 16 F; 83/782, 779, 776

[56] References Cited

U.S. PATENT DOCUMENTS 2,587,250 2/1952 Valgiusti ..... 125/19
2,712,307 7/1955 Stalheim ..... 125/16 R
2,963,018 12/1960 Mattson .

FOREIGN PATENT DOCUMENTS 487264 11/1953 Italy ..... 125/16 R
28197 3/1916 Norway ..... 125/16 L

*Primary Examiner*—Harold D. Whitehead
*Attorney, Agent, or Firm*—Robert R. Schroeder

[57] ABSTRACT

An improved vertical gang saw is provided for sawing blocks of stone or the like. By this new design, the vertical saw frame is slued or swung about the center of the blades during each reciprocating movement. This design combines the following features:

(a) the vertical frame (5) being supported at the center (13);

(b) straight line guides (6 and 7) connected to said frame and positioned respectively at one end (21) and in the center (13) of the saw frame (5); and (c) the pivotal point of the straight line guide (6) being moveable perpendicular to the stroke of the frame and dependent thereupon.

The perpendicular movement of the straight line guides can be accomplished by connecting them with a cam (10) which is driven off of the flywheel (3). Through this combination, all of the saw blades cut the stone block workpiece in both the up and down directions.

5 Claims, 2 Drawing Figures

GANG SAW FOR CUTTING BLOCKS OF STONE

This application is a continuation of application Ser. No. 07/268,448, filed May 29, 1981 now abandoned.

TECHNICAL FIELD

This invention relates to a gang saw for cutting large blocks of stone, more particularly to a vertical frame saw.

BACKGROUND

For cutting blocks of marble, concrete, granite or the like, it is common to use either gang saws with horizontal or vertical reciprocating movement of the saw blade or blades. While these devices originally operated in such a manner that cutting was effected only when the saw blades moved either back or forth, and an idle stroke took place in the other direction, for reasons of economy one has in the meantime reverted to a method of cutting wherein the sawing takes place in both back and forth directions. Thus, for example, French Pat. No. 986,183 teaches a horizontal-gang in which the reciprocating movement of the saw frame provided with saw blades is overlapped by an up and down movement whereby the saw frame describes a movement similar to a double ellipse or a horizontal FIG. 8. The selected configuration is such as to allow each of the saw blades to cut the stone as they reciprocate from the center toward either end which is advantageous in that swarf formed during cutting, comprising cooling water, splintered off stone and abraded abrasive, is removed proceeding from the middle of the stone block towards its sides and accordingly, the wear is favorably affected.

A basic disadvantage of horizontal frame saws is, however, the limitation of the block sizes in all dimensions as well as the necessary relatively great length of the saw blades which means that the saw blade cross-section must be relatively large. Also, great tensional forces are required for fitting the saw blades in the saw frames which in their turn necessitate a very stable and therefore heavy construction of the frame.

These disadvantages are overcome by using vertical gang machines. However, the small number of hitherto known embodiments, such as that disclosed in the Belgian Pat. No. 530,257, have the disadvantage that during the up and down movement of the saw blades, the latter cut merely in one direction usually during the downward motion, and, as a consequence thereof, have an idle stroke which impairs the capacity of these machines.

In order to improve the capacity of gang saws for handling stones or the like, to reduce the wear occurring thereby and to obtain an unobjectionable cut, it is the object of the invention to combine the advantages of the various gang saw embodiments, yet without adopting their disadvantages.

SUMMARY OF THE INVENTION

This object is achieved by a gang saw as described in claim 1. The vertical arrangement of the saw frame with saw blades fitted therein allows the cutting of blocks for practically unlimited length by utilizing relatively short saw blades which is an advantage both in respect of equipment costs as well as a minor lateral turn of the cut, especially since a relatively small blade cross-section may be selected allowing a reduction of the frame weight as less tensional forces would be necessary. In view of the guidance of the centrally pivoted saw frame by the additionally provided straight-line guides, a relatively efficient straight-line guidance is achieved over a substantial part of the up and down motion. In addition, the straight-line guides are advantageous in that slide bars with their greater and mostly non-uniform wear tendency become superfluous. Consequently, the gang stroke is calmer and more uniform, allowing the operation to be conducted at higher speed, i.e. with more efficient strokes and cutting capacity. Finally, that the pivotal point of the one guide is displaceable perpendicular to the stroke and dependent thereupon, makes it possible to cut in both directions whereby cutting forces acting only in the one and the same direction occur at each of the operating saw blade segments. Due to the sluing or swinging of the saw frame during one course of movement in the area of the upper and lower dead center only about one half of the saw blade length is engaged in the cutting, i.e. always the one saw blade half in the one direction and the other saw blade half in the other direction so that almost half of the block is cut by each saw blade half respectively. As a result thereof, at a higher specific load of the cutting segments, the saw blades are subject to less load during the cutting operation. The advantageous force action at the saw blades in the area where they are fastened to the frame substantially removes the danger of a lateral turn of the saw blades and a better cut is obtained. The effect is similar when the swivelling of the saw frame at the area of the upper and lower dead center of the stroke takes place such that each half saw blade cuts the block half assigned thereto from an outward to an inward direction because when the block is cut this is done at first solely in the edge region and is then progressively extended to the entire block half by reason of the minor inclination of the saw frame relative to the block so that the saw blades are initially subjected to a minimum load which is advantageous in respect of an exact and planned course of the cut.

A useful further embodiment of the invention is a configuration wherein the center of rotation of the saw frame coincides with the pivotal point of the guides located at the center of said frame. In a preferred embodiment the pivotal point of one of the straight-line guide levers positioned at the end of the saw frame is mounted such that it is slideable or displaceable by means of a cam, which is driven by the flywheel or drive wheel which also drives the push rod which brings about the reciprocating movement of the same frame. By this arrangement, very advantageous conditions are created both from a kinematic point of view as well as in respect of the dimensioning of the parts since the eccentric adjustment equally affects the upper and lower saw frame halves and the function of the central guides is practically unchanged.

Since by virtue of the claimed arrangement and configuration of the gang saw high cutting rates and consequently high stroke numbers are achieved and large masses can be rapidly moved, great importance is attached to mass balance and, therefore, in a further embodiment of the invention, it is possible to bring about a mass balance of the first and eventually second order. In particular, it is possible to bring about a complete mass balance, i.e. to arrange the moved masses in a manner known and to supplement the same by counter-weights such that the inertia effects within the moving system mutually cancel. Accordingly, compulsive forces do not occur which, otherwise, would have to be taken into consideration by an appropriate heavy and stable constuction of the members.

It is another advantage to allow the push rod which initiates the reciprocating movement of the saw frame, and the saw blades bitted therein, to engage at the point of rotation of said saw frame. It is also preferred to arrange the block to be cut with respect to its height such that the center of said height approximately coincides with the center of the gang stroke, whereby a substantially uniform load of the parts and, in particular, of the two saw blade halves, results.

In order to ensure that the block to be cut has a steady safe and good support and does not change its position laterally and in respect of its height when being pushed in the direction of the gang during cutting, the invention provides the block during the handling operation with a substantially plane supporting surface and plane parallel side guides by applying a filler to its bottom side and the lower area of its longitudinal sides.

BRIEF DESCRIPTION OF THE DRAWINGS

The invention is shown in the drawings in a practical example and will be illustrated in the following by means thereof. The diagrammatic representation shows.

DESCRIPTION OF THE PREFERRED EMBODIMENTS

Figure 1:
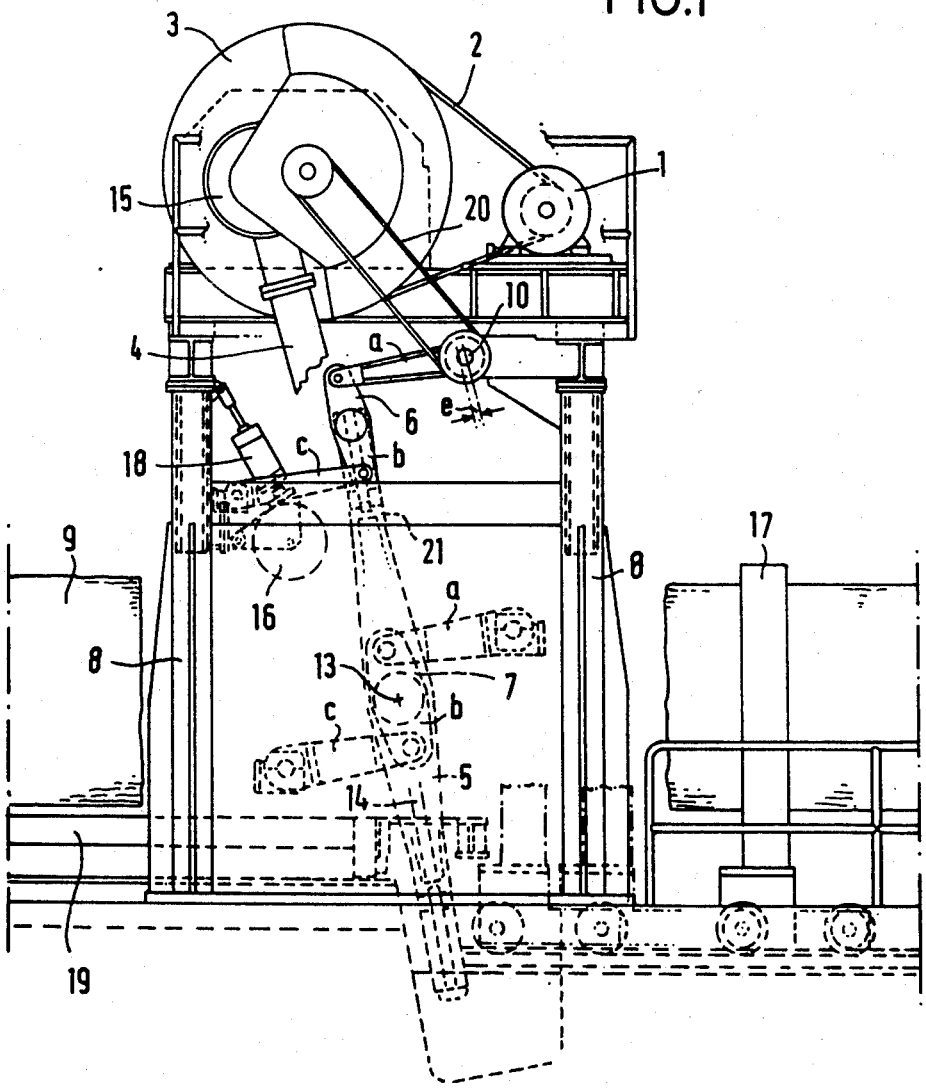
FIG. 1, a side view of the gang saw according to the invention.

The saw frame 5 provided with saw blades 14, shown as dotted lines in FIG. 1 is hingedly connected to the support 8 by means of the two so-called Watt-guide rods 6 and 7, also known under the name Lemniskoid guide rods, each having the three levers a, b and c. Motors 1, via drives 2 and flywheels or drive wheels 3, drive push rods 4 which are eccentrically pivoted on said flywheels 3 via crank pins 15. Said push rods being hingedly secured with their other end at point 13 to saw frame 5, said saw frame 5 is driven to and fro in the direction of its longitudinal extension and is guided by the watt-guide rods 6 and 7 in an approximately straight line. Guide rod 7 is arranged at said saw frame 5 and support 8 in such a manner that the center of rotation of lever 7*b*, connected to said saw frame 5, is located in the center of the stroke of said saw frame 5, i.e. with one complete stroke it reaches half the stroke below and above the middle of the height of the block to be cut 9. Lever 6*a* is hingedly connected to support 8 via cam 10 which is driven via drive 20 at the same rate of revolutions as flywheel 3. Cam 10 is adapted and arranged such as to displace the pivotal point of lever 6*a* at support 8 during the reciprocating movement of said saw frame 5 by the amount "e" to the one and other side respectively. The pivotal point of lever 6*b* at saw frame 5 is thereby displaced by the amount "e/2" towards one side and the other respectively. As a consequence thereof, said saw frame 5 performs as it reciprocates a rotational movement about its pivotal point 13. Thus, saw blades 14 during their forward motion with their one half and their backward motion with their other half rest against the upper and lower block half respectively (with respect to its height) and cut the block as they move in longitudinal direction. It is useful to provide for a variable eccentricity so as to be able by appropriate adjustment to adjust in the desired manner the swivelling of said saw frame 5 and, accordingly, the slant of the cut at block 9. Although the swivelling of the gang extends over the entire stroke, it is nevertheless ensured by virtue of the straight-line guides that most of the swivelling takes place in the area of the upper and lower dead center positions of the gang stroke with the saw frame describing an inclined almost straight-line path in the up and down directions.

The tension rollers are denoted by number 16 by means of which stone block 9, via devices 18 (for example pneumatic cylinders) is pressed against the table 19 of the gang saw. A transfer car is deonted by number 17, serving for the further transport of the cut block pieces.

Figure 2:
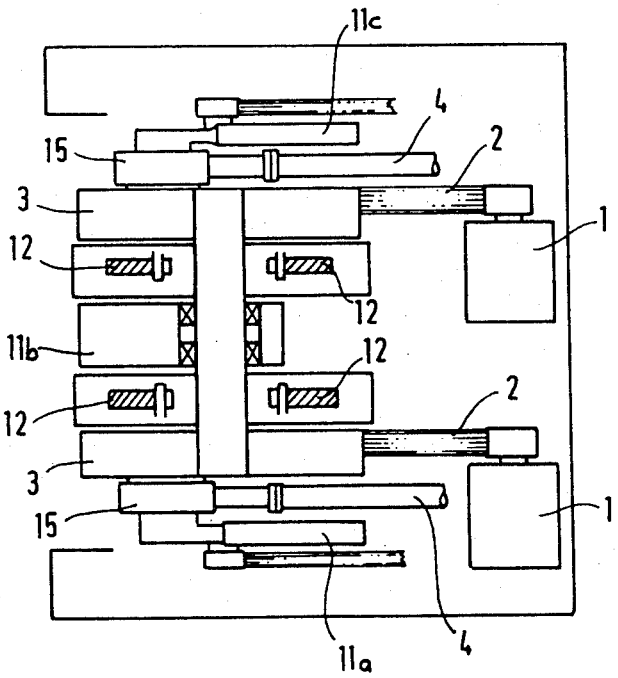
FIG. 2, a top plan view.

As can be seen from FIG. 2, for the mass balance of the first order, counter-weights 11 are provided rotating at the same number of revolutions as fly wheels 3 and guide rods 6 and 7. However, the mass of the counter-weights 11 is halved. That is, the mass of center counterweight 11*b* equals that of the two outer counter-weights 11*a* and 11*c*. The center counter-weight 11*b* rotates in an opposite direction to that of the outer counter-weights 11*a* and 11*c* thus avoiding free forces in the horizontal which might act upon the gang support as tilting forces. For the mass balance of the second order, masses 12 are provided, the latter rotating with double the number of rotations per minute of said flywheels 3 and balancing the mass forces created by the constantly changing acceleration of the push rods 4. In this connection, the masses are arranged in pairs and rotate in opposite direction so that free mass forces do not occur in this case either. For balancing half of the push rod weight and the mass of the crankpins, corresponding masses are provided in or connected to said flywheels.

Before placing block 9 on table 19 for cutting, it is filled up at its bottom side and lower sections of its two longitudinal sides with a filler such that a totally plane and exact bottom area as well as respective lateral guides are formed. Via screwed spindles or the like, not shown, which are driven by a likewise not shown gear unit, block 9 is driven by means of a likewise not shown traverse in the direction of gang saw 5, 14, and prior to cutting said block is pressed against table 19 by device 16, 18. Behind gang 5, 14, transfer cars 17 take charge of the further transport of the cut block pieces.

Differing from the illustrated embodiment, it is, of course, possible to arrange the drives of the gang saw not at the top but at the bottom. Likewise, saw frame 5 with saw blades 14 may also be arranged in an exactly vertical position with respect to its central stroke position so that it is displaced in the area of its upper and lower dead center merely by half the amount of eccentricity from the vertical towards the one and other side respectively. While following the principle of the invention with its advantages regarding high possible cutting rates and cutting capacities, it is also possible to provide further different kinematic devices for guiding saw frame 5 with saw blades 14 or, the dimensions, engaging points etcetera of the shown parts may be varied in many respects. For example, it would be also possible to bring about the swivelling of the saw frame 5 by using cam disks, servo motors or cam controls arranged in the upper or lower area of said frame. Thus, the sluing or swinging of the saw frame may be basically effected directly in the upper or lower dead center of the stroke, more or less suddenly, it being in this case, of course, necessary to provide for appropriate constructive measures.

I claim:

1. An improved vertical gang saw for sawing blocks of stone or the like, having a saw frame which is symmetrically provided with saw blades, is attached to a support, and is driven by drive means, the improvement which comprises:

said frame being driven at its center by said drive means to provide an up stroke and a down stroke from said frame center;

said frame being attached to said support by straight line guide means connected to said frame respectively at an end and at said center of said frame, said straight line guide means arranged to provide approximately straight line movement of said frame;

said frame end straight line guide means being moveable to reciprocatingly pivot said frame about is center at the end of each stroke, whereby a first portion of said saw blades engage said blocks during each up stroke, a second portion of said saw blades engage said blocks during each down stroke, and each said portion contacts different portions of said blocks.

2. The gang saw of claim 1 wherein said straight line guide means are Watt-guide rods comprising three levers each, the middle lever of the Watt-guide rod attached at the center of said frame having its center which coincides with said center of said frame.

3. The gang saw of claim 2 wherein said drive means comprises a flywheel connected to a push rod which is connected to said frame at its center; and one of said levers of said Watt-guide rods attached to said frame end also is connected to and moveable by means of a cam, the movement of said cam being dependent upon the rotation of said flywheel.

4. The gang saw of claim 3 which further contains rotating counterweights to provide a mass balance of the first and second order.

5. The gang saw of claim 1 wherein said block to be cut is positioned with respect to its height such that its center approximately coincides with the center of the stroke of said frame, whereby about one-half of said saw blades engage only about the top half of said block and the remaining portion of said saw blades engage only about the bottom half of said block.

* * * * *